US010082356B2

(12) United States Patent
Karagias

(10) Patent No.: US 10,082,356 B2
(45) Date of Patent: Sep. 25, 2018

(54) MULTI-CALIBER FIREARMS, BOLT MECHANISMS, BOLT LUGS, AND METHODS OF USING THE SAME

(71) Applicant: Theodore Karagias, Seattle, WA (US)

(72) Inventor: Theodore Karagias, Seattle, WA (US)

( * ) Notice: Subject to any disclaimer, the term of this patent is extended or adjusted under 35 U.S.C. 154(b) by 0 days.

(21) Appl. No.: 15/193,483

(22) Filed: Jun. 27, 2016

(65) Prior Publication Data

US 2017/0010064 A1 Jan. 12, 2017

Related U.S. Application Data

(63) Continuation of application No. 14/613,350, filed on Feb. 3, 2015, now Pat. No. 9,377,255.

(60) Provisional application No. 61/971,253, filed on Mar. 27, 2014, provisional application No. 61/935,307, filed on Feb. 3, 2014.

(51) Int. Cl.

| | |
|---|---|
| ***F41A 3/66*** | (2006.01) |
| ***F41A 3/64*** | (2006.01) |
| ***F41A 35/06*** | (2006.01) |
| ***F41C 23/04*** | (2006.01) |
| ***F41A 3/14*** | (2006.01) |
| ***F41A 3/22*** | (2006.01) |

(52) U.S. Cl.

CPC ..... *F41A 35/06* (2013.01); *F41A 3/14* (2013.01); *F41A 3/22* (2013.01); *F41A 3/66* (2013.01); *F41C 23/04* (2013.01)

(58) Field of Classification Search

CPC ..... F41A 3/64; F41A 3/66; F41A 3/68; F41A 5/02; F41A 5/04; F41A 5/14

USPC ..... 42/75.02, 75.04

See application file for complete search history.

(56) References Cited

U.S. PATENT DOCUMENTS

| | | | | | |
|---|---|---|---|---|---|
| 119,939 | A | | 10/1871 | Merrill | |
| 193,060 | A | * | 7/1877 | Wesson | F41A 3/10 42/23 |
| 467,180 | A | | 1/1892 | Mauser | |
| 477,671 | A | | 6/1892 | Mauser | |
| 592,239 | A | * | 10/1897 | Davenport | F41A 3/10 42/23 |
| 652,583 | A | * | 6/1900 | Baird | F41C 7/11 42/71.01 |
| 1,588,887 | A | * | 6/1926 | Haubroe | F41A 11/04 42/75.03 |
| 2,290,778 | A | * | 7/1942 | Swebilius | F41A 3/64 42/17 |
| 2,341,298 | A | | 2/1944 | Sweany | |
| 2,484,977 | A | | 10/1949 | Wilcox | |
| 2,514,981 | A | | 7/1950 | Walker et al. | |
| 2,543,604 | A | | 2/1951 | Singer | |
| 2,558,872 | A | | 7/1951 | Miller | |
| 2,775,836 | A | | 1/1957 | Emerson | |
| 2,780,145 | A | * | 2/1957 | Saive | F41A 3/32 42/16 |

(Continued)

*Primary Examiner* — Derrick R Morgan

(74) *Attorney, Agent, or Firm* — Perkins Coie LLP

(57) ABSTRACT

Firearms with bolt mechanisms, ambidextrous functionality, and/or isolated receivers are disclosed herein. A multi-caliber ambidextrous firearm can have a receiver and a bolt mechanism with a bolt that seats against one or more load bearing surfaces of the receiver. The load bearing surfaces can be configured to maintain proper contact before, during, and/or after a firing event. A bolt head of the bolt mechanism can be replaced to use the bolt mechanism with different cartridges.

6 Claims, 10 Drawing Sheets

(56) References Cited

U.S. PATENT DOCUMENTS 2,881,547 A * 4/1959 Butler ..... F41A 3/18 42/16
3,183,615 A * 5/1965 Hirsch ..... F41A 9/18 42/11
3,198,076 A * 8/1965 Stoner ..... F41A 3/26 42/75.02
3,253,362 A 5/1966 Gitchell
3,287,842 A * 11/1966 Denhoff ..... F41A 3/66 42/16
3,380,183 A * 4/1968 Sullivan ..... F41A 3/26 42/75.02
3,610,714 A 10/1971 DeGaeta
3,830,000 A * 8/1974 Browning ..... F41A 15/08 42/23
3,939,679 A 2/1976 Barker et al.
3,949,508 A 4/1976 Elkas
3,950,876 A 4/1976 Wild et al.
3,951,038 A 4/1976 Van Langenhoven
3,951,126 A 4/1976 Rau
3,955,300 A 5/1976 Folsom et al.
3,955,469 A 5/1976 Conley
3,956,967 A 5/1976 Martz
3,958,549 A 5/1976 Johansson et al.
3,960,053 A 6/1976 Conley
3,964,368 A 6/1976 Zimeri Safie
3,975,982 A * 8/1976 Terstegge ..... F41A 3/64 89/163
3,979,849 A 9/1976 Haskins
3,983,270 A 9/1976 Licari et al.
3,985,060 A 10/1976 Conley
3,988,849 A 11/1976 Connellan et al.
3,996,686 A 12/1976 Baker
3,999,461 A 12/1976 Johnson et al.
4,000,575 A 1/1977 Ruger et al.
4,002,156 A 1/1977 Fischer
4,003,152 A 1/1977 Barker et al.
4,004,364 A 1/1977 Chatigny
4,004,496 A 1/1977 Snodgrass et al.
4,011,790 A 3/1977 Folsom et al.
4,014,247 A 3/1977 Tollinger
4,016,668 A 4/1977 Frazier
4,016,669 A 4/1977 Gminder
4,019,480 A 4/1977 Kenaio
4,024,792 A 5/1977 Moller
4,031,840 A 6/1977 Boisrayon et al.
4,048,901 A 9/1977 Ghisoni
4,052,926 A 10/1977 Tollinger
4,054,003 A 10/1977 Wilson
4,058,924 A 11/1977 Mullner
4,065,867 A 1/1978 Storey
4,066,000 A 1/1978 Rostocil
4,069,702 A 1/1978 Hayner
4,085,511 A 4/1978 Kovac
4,103,586 A 8/1978 Tollinger
4,105,030 A 8/1978 Kercso
4,122,621 A 10/1978 Barr
4,123,963 A 11/1978 Junker
4,138,789 A 2/1979 Langsford
4,141,274 A 2/1979 Gerber
4,143,636 A 3/1979 Liepins et al.
4,150,656 A 4/1979 Curran
4,151,670 A 5/1979 Rath
4,151,782 A 5/1979 Allen
4,158,926 A 6/1979 Kordas et al.
4,161,904 A 7/1979 Groen et al.
4,163,334 A 8/1979 Tollinger
4,164,929 A 8/1979 Liepins et al.
4,173,964 A 11/1979 Curran
4,185,537 A 1/1980 Hayashi
4,194,433 A 3/1980 Zellweger et al.
4,194,846 A 3/1980 Zerillo
4,200,028 A 4/1980 Bains
4,227,439 A 10/1980 Gillum
4,232,583 A 11/1980 Harrison
4,245,418 A 1/1981 Kennedy
4,257,310 A 3/1981 Folsom et al.
4,266,358 A 5/1981 Phillips et al.
4,269,386 A 5/1981 Crowe
4,275,640 A 6/1981 Wilhelm
4,282,796 A 8/1981 Stoner et al.
4,296,564 A 10/1981 Oberst
4,301,609 A 11/1981 Peterson et al.
4,301,709 A 11/1981 Bohorquez et al.
4,305,218 A 12/1981 Godsey
4,305,326 A 12/1981 Sallach et al.
4,308,786 A 1/1982 Hayashi
4,316,341 A 2/1982 Landry
4,321,764 A 3/1982 Wilhelm
4,328,737 A 5/1982 Nelson et al.
4,329,803 A 5/1982 Johnson et al.
4,335,643 A 6/1982 Gal
4,336,743 A 6/1982 Horn et al.
4,352,317 A 10/1982 Wilhelm
4,357,888 A 11/1982 Phillips et al.
4,358,985 A 11/1982 Hamilton
4,358,986 A 11/1982 Giorgio
4,358,987 A 11/1982 Wilhelm
4,361,975 A 12/1982 Wilhelm
4,362,397 A 12/1982 Klingenberg
4,378,614 A 4/1983 McKenney
4,383,383 A 5/1983 Landry
4,387,524 A 6/1983 Brint et al.
4,395,938 A 8/1983 Curtis
4,400,900 A 8/1983 Hillberg et al.
4,400,901 A 8/1983 Hillberg
4,407,085 A 10/1983 Hillberg et al.
4,416,186 A 11/1983 Sullivan
4,422,254 A 12/1983 McQueen
4,424,735 A 1/1984 Bacon et al.
4,445,292 A 5/1984 Martin
4,449,312 A 5/1984 Ruger et al.
4,450,751 A 5/1984 Thevis
4,452,001 A * 6/1984 Compton ..... F41A 3/10 42/23
4,453,329 A 6/1984 Brint et al.
4,455,919 A 6/1984 Osborne et al.
4,459,849 A 7/1984 Calamera
4,462,179 A 7/1984 Rogak et al.
4,463,654 A 8/1984 Barnes et al.
4,466,417 A 8/1984 Mulot et al.
4,467,698 A 8/1984 Perrine
4,468,876 A 9/1984 Ghisoni
4,468,877 A 9/1984 Karvonen
4,469,006 A * 9/1984 Teppa ..... F41A 19/31 89/149
4,471,549 A 9/1984 Brint et al.
4,475,437 A 10/1984 Sullivan
4,481,859 A 11/1984 Dix
4,492,145 A 1/1985 Curtis
4,494,439 A 1/1985 Sawyer
4,499,684 A 2/1985 Repa
4,502,367 A 3/1985 Sullivan
4,505,182 A 3/1985 Sullivan
4,512,236 A 4/1985 Thevis et al.
4,515,064 A 5/1985 Hohrein
4,522,105 A 6/1985 Atchisson
4,522,106 A 6/1985 Sullivan
4,523,510 A 6/1985 Wilhelm
4,531,444 A 7/1985 Jackson
4,532,852 A 8/1985 Hance et al.
4,547,988 A 10/1985 Nilsson
4,551,936 A 11/1985 Chauvet
4,553,468 A 11/1985 Castellano et al.
4,553,469 A 11/1985 Atchisson
4,555,205 A 11/1985 Hiroyasu et al.
4,563,936 A 1/1986 Cleary et al.
4,563,937 A 1/1986 White
4,569,145 A 2/1986 Ruger et al.
4,570,369 A 2/1986 Gerfen
4,579,034 A 4/1986 Holloway
4,587,879 A 5/1986 Savioli
4,589,326 A 5/1986 Kuckens et al.
4,589,327 A 5/1986 Smith

(56) References Cited

U.S. PATENT DOCUMENTS 4,590,697 A 5/1986 Ruger et al.
4,597,211 A 7/1986 Miles
4,648,190 A 3/1987 Allen
4,653,210 A 3/1987 Poff
4,654,993 A 4/1987 Atchisson
4,656,919 A 4/1987 Farinacci et al.
4,664,015 A 5/1987 Kennedy
4,665,793 A 5/1987 Cleary et al.
4,671,005 A 6/1987 Jewell
4,672,761 A 6/1987 Hart
4,672,762 A 6/1987 Nilsson
4,677,897 A 7/1987 Barrett
4,680,884 A 7/1987 Smith et al.
4,693,170 A 9/1987 Atchisson
4,698,931 A 10/1987 Larsson
4,700,608 A 10/1987 Pettinga et al.
4,709,617 A 12/1987 Anderson
4,709,686 A 12/1987 Taylor et al.
4,719,841 A * 1/1988 Perrine ..... F41A 3/50
42/70.04
4,723,369 A 2/1988 Badali
4,727,670 A 3/1988 Krouse
4,732,074 A 3/1988 Normand
4,754,567 A 7/1988 Lehfeldt et al.
4,774,929 A 10/1988 Milliman
4,787,288 A 11/1988 Miller
4,791,851 A 12/1988 Stoner
4,791,908 A 12/1988 Pellis
4,821,621 A 4/1989 Lorenzo
4,856,410 A 8/1989 Anderson
4,867,040 A 9/1989 Barrett
4,870,770 A 10/1989 Forbes et al.
4,872,391 A 10/1989 Stoner
4,874,367 A 10/1989 Edwards
4,879,827 A 11/1989 Gentry
4,881,517 A 11/1989 Wackrow et al.
4,890,405 A 1/1990 Krouse
4,893,545 A 1/1990 Sanderson et al.
4,893,547 A 1/1990 Atchisson
4,897,949 A 2/1990 Whiteing
4,908,970 A 3/1990 Bell
4,920,677 A 5/1990 Schuerman
4,926,574 A 5/1990 Rieger
4,930,238 A 6/1990 Poff
4,930,399 A 6/1990 Trevor
4,937,964 A 7/1990 Crandall
4,938,116 A 7/1990 Royster
4,966,063 A 10/1990 Sanderson et al.
4,974,499 A 12/1990 Sanderson et al.
4,977,815 A 12/1990 Stephens
4,987,693 A 1/1991 Brooks
4,989,357 A 2/1991 Norman et al.
5,012,604 A 5/1991 Rogers
5,018,292 A 5/1991 West
5,024,138 A 6/1991 Sanderson et al.
5,024,139 A 6/1991 Knight et al.
5,035,692 A 7/1991 Lyon et al.
5,050,480 A 9/1991 Knight et al.
5,050,481 A 9/1991 Knight et al.
5,054,365 A 10/1991 Wissing
5,065,662 A 11/1991 Bullis et al.
5,067,266 A 11/1991 Findlay
5,073,165 A 12/1991 Edwards
5,078,043 A 1/1992 Stephens
5,081,780 A 1/1992 Lishness et al.
5,086,578 A 2/1992 Lishness et al.
5,096,155 A 3/1992 Fitzgerald
5,105,570 A 4/1992 Lishness et al.
5,127,310 A 7/1992 Lishness et al.
5,133,331 A 7/1992 Hutchinson
5,155,292 A 10/1992 Rostcil et al.
5,157,209 A 10/1992 Dunn
5,161,516 A 11/1992 Ekstrom
5,164,534 A 11/1992 Royster
5,205,942 A 4/1993 Fitzgerald
5,229,539 A 7/1993 Rommel
5,259,137 A 11/1993 Blenk et al.
5,259,138 A 11/1993 Scirica
5,280,778 A 1/1994 Kotsiopoulos
5,299,722 A 4/1994 Cheney
5,308,945 A 5/1994 Van Handel et al.
5,325,760 A 7/1994 Dennis
5,329,685 A 7/1994 Gillespie
5,349,938 A 9/1994 Farrell
5,357,939 A 10/1994 Tentler et al.
5,359,921 A 11/1994 Wolff et al.
5,363,581 A 11/1994 Blenk et al.
5,370,036 A 12/1994 Stoner
5,383,389 A 1/1995 Wolff et al.
5,410,135 A 4/1995 Pollart et al.
5,413,083 A 5/1995 Jones
5,440,963 A 8/1995 Szecsei
5,458,046 A 10/1995 Blenk et al.
5,469,853 A 11/1995 Law et al.
5,484,092 A 1/1996 Cheney
5,487,233 A 1/1996 Jewell
5,497,758 A 3/1996 Dobbins et al.
5,499,569 A 3/1996 Schuetz
5,509,399 A 4/1996 Poor
5,515,838 A 5/1996 Anderson
5,522,374 A 6/1996 Clayton
5,551,180 A 9/1996 Findlay et al.
5,558,077 A 9/1996 Linsmeyer
5,572,982 A 11/1996 Williams
5,585,590 A 12/1996 Ducolon
5,586,545 A 12/1996 McCaslin
5,615,662 A 4/1997 Tentler et al.
5,649,520 A 7/1997 Bednar
5,653,051 A 8/1997 Pons et al.
5,653,213 A 8/1997 Linsmeyer
5,659,992 A 8/1997 Mistretta
5,673,505 A 10/1997 Phillips
5,673,679 A 10/1997 Walters
5,680,853 A 10/1997 Clayton
5,682,699 A 11/1997 Gentry
5,691,497 A 11/1997 Weichert et al.
5,701,878 A 12/1997 Moore et al.
5,704,342 A 1/1998 Gibson et al.
5,718,074 A 2/1998 Keeney
5,722,193 A 3/1998 Post
5,722,383 A 3/1998 Tippmann, Sr. et al.
5,724,759 A 3/1998 Kilham
5,726,377 A 3/1998 Harris et al.
5,736,667 A 4/1998 Munostes et al.
5,743,039 A 4/1998 Garrett
5,770,814 A 6/1998 Ealovega
5,771,875 A 6/1998 Sullivan
5,783,753 A 7/1998 Kellerman
5,784,818 A 7/1998 Otteson
5,787,629 A 8/1998 Campbell et al.
5,813,158 A 9/1998 Campbell et al.
5,826,362 A 10/1998 Lyons
5,827,992 A 10/1998 Harris et al.
5,857,280 A 1/1999 Jewell
5,878,736 A 3/1999 Lotuaco, III
5,900,577 A * 5/1999 Robinson ..... F41A 11/02
89/156
5,913,303 A 6/1999 Kotsiopoulos
5,915,934 A 6/1999 Knight et al.
5,939,657 A 8/1999 Morgado
5,954,043 A 9/1999 Mayville et al.
5,974,940 A 11/1999 Madni et al.
6,024,077 A 2/2000 Kotsiopoulos
6,065,460 A 5/2000 Lotuaco, III
6,070,352 A 6/2000 Daigle
6,073,380 A 6/2000 Hauser et al.
6,101,918 A 8/2000 Akins
6,131,324 A 10/2000 Jewell
6,142,058 A 11/2000 Mayville et al.
6,164,001 A 12/2000 Lee
6,176,169 B1 1/2001 Rostocil
6,189,253 B1 2/2001 Knight et al.
6,205,990 B1 3/2001 Adkins
6,209,249 B1 4/2001 Borden

(56) References Cited

U.S. PATENT DOCUMENTS 6,226,915 B1 5/2001 Kotsiopoulos
6,234,058 B1 5/2001 Morgado
6,263,776 B1 7/2001 Rostocil
6,293,203 B1 9/2001 Alexander et al.
6,305,113 B1 10/2001 Calvete
6,345,460 B2 2/2002 Hashman
6,345,461 B1 2/2002 Constant et al.
6,345,462 B1 2/2002 Mikuta et al.
6,345,463 B1 2/2002 Baer, Sr.
6,354,320 B1 3/2002 Kolacz et al.
6,360,467 B1 3/2002 Knight
6,360,468 B1 3/2002 Constant et al.
6,360,469 B1 3/2002 Mikuta et al.
6,360,470 B1 3/2002 Constant et al.
6,401,378 B1 6/2002 Ockenfuss
6,401,592 B1 6/2002 Rostocil
6,403,602 B1 6/2002 Crooks et al.
6,412,206 B1 7/2002 Strayer
6,412,208 B1 7/2002 Mikuta et al.
6,425,386 B1 7/2002 Adkins
6,432,559 B1 8/2002 Tompkins et al.
6,460,281 B1 10/2002 Schaeffer
6,470,872 B1 10/2002 Tiberius et al.
6,477,802 B2 11/2002 Baer, Sr.
6,508,025 B1 1/2003 Du
6,516,791 B2 2/2003 Perrone
6,520,172 B2 2/2003 Perrone
6,530,305 B1 3/2003 MacLeod et al.
6,532,876 B1 3/2003 Ramirez et al.
6,553,706 B1 4/2003 Gancarz et al.
6,560,909 B2 5/2003 Cominolli
6,594,938 B2 7/2003 Horton
6,604,311 B1 * 8/2003 Laney ..... F41A 3/06 42/34
6,625,917 B2 9/2003 Murello et al.
6,631,709 B2 10/2003 Carter et al.
6,634,129 B1 10/2003 Freeman, Jr.
6,650,669 B1 11/2003 Adkins
6,668,478 B2 12/2003 Bergstrom
6,679,150 B1 1/2004 Ramirez et al.
6,681,511 B1 1/2004 Huber
6,698,918 B2 3/2004 Durand
6,701,909 B2 3/2004 Tiberius et al.
6,708,685 B2 3/2004 Masse
6,718,680 B2 4/2004 Roca et al.
6,722,072 B1 4/2004 McCormick
6,729,322 B2 5/2004 Schavone
6,735,897 B1 5/2004 Schmitter et al.
6,760,991 B1 7/2004 Gentry
6,782,791 B2 8/2004 Moore
6,789,342 B2 9/2004 Wonisch et al.
6,796,067 B2 9/2004 Popikow
6,820,533 B2 11/2004 Schuerman
6,820,608 B2 11/2004 Schavone
6,832,605 B2 12/2004 Farrell
6,874,492 B1 4/2005 Schavone
6,892,718 B2 5/2005 Tiberius et al.
6,901,689 B1 6/2005 Bergstrom
6,907,687 B2 6/2005 Rousseau et al.
6,907,813 B2 6/2005 Gablowski
6,919,111 B2 7/2005 Swoboda et al.
6,925,744 B2 8/2005 Kincel
6,948,273 B2 9/2005 Baker
7,051,467 B1 5/2006 Huber
7,181,680 B2 2/2007 Lin et al.
7,331,135 B2 2/2008 Shimi
7,340,987 B1 * 3/2008 Williams ..... F41A 3/64 42/15
7,363,740 B2 4/2008 Kincel
7,430,827 B1 10/2008 Huber
7,555,900 B1 7/2009 Vallance et al.
7,596,900 B2 10/2009 Robinson et al.
7,743,543 B2 6/2010 Karagias
7,827,724 B1 11/2010 Spinelli
8,069,600 B2 12/2011 Rousseau et al.
8,099,895 B2 1/2012 Farley, Jr. et al.
8,215,045 B2 7/2012 Mitchell
8,230,633 B1 7/2012 Sisk
8,302,340 B1 11/2012 Irwin
8,307,575 B1 * 11/2012 Battaglia ..... F41A 3/64 42/75.03
8,474,171 B1 * 7/2013 Simmons ..... F41A 11/04 42/108
8,769,854 B1 * 7/2014 Battaglia ..... F41A 3/66 42/71.01
8,819,976 B1 * 9/2014 Kellgren ..... F41A 21/482 42/6
8,997,620 B2 4/2015 Brown
9,188,399 B1 * 11/2015 Findlay ..... F41A 3/66
9,328,980 B1 * 5/2016 Doto ..... F41A 3/66
9,377,255 B2 * 6/2016 Karagias ..... F41C 23/04
9,404,694 B2 * 8/2016 Hochstrate ..... F41A 3/26
2002/0071349 A1 6/2002 Durand
2002/0153982 A1 10/2002 Jones et al.
2005/0011346 A1 1/2005 Wolff et al.
2006/0277810 A1 * 12/2006 Leitner-Wise ..... F41A 3/66 42/75.03
2007/0079539 A1 4/2007 Karagias
2007/0116546 A1 5/2007 Dearing
2008/0005951 A1 * 1/2008 Gorzen ..... F41A 3/10 42/14
2010/0170130 A1 * 7/2010 Tertin ..... F41A 3/72 42/69.02
2010/0229445 A1 * 9/2010 Patel ..... F41A 3/66 42/6
2010/0281732 A1 * 11/2010 Laney ..... F41C 7/11 42/8
2011/0030261 A1 2/2011 Karagias
2011/0099874 A1 * 5/2011 Zedrosser ..... F41A 3/66 42/73
2012/0055058 A1 3/2012 Picard et al.
2012/0210859 A1 8/2012 Doll et al.
2012/0297656 A1 * 11/2012 Langevin ..... F41A 3/66 42/16
2013/0139424 A1 * 6/2013 Devine ..... F41A 3/26 42/16
2014/0076144 A1 3/2014 Gomez
2014/0144314 A1 5/2014 Jensen
2014/0224114 A1 * 8/2014 Faxon ..... F41A 15/14 89/193
2014/0230297 A1 8/2014 Larson, Jr. et al.
2015/0052794 A1 * 2/2015 Underwood ..... F41A 3/66 42/16
2015/0198394 A1 * 7/2015 Hochstrate ..... F41A 3/26 42/17
2015/0233656 A1 * 8/2015 Karagias ..... F41C 23/04 42/16
2016/0033218 A1 * 2/2016 Folkestad, II ..... F41A 3/66 89/194
2016/0209136 A1 * 7/2016 Schuetz ..... F41A 3/66
2017/0191773 A1 * 7/2017 Oz ..... F41A 11/02

* cited by examiner

MULTI-CALIBER FIREARMS, BOLT MECHANISMS, BOLT LUGS, AND METHODS OF USING THE SAME

CROSS-REFERENCE TO RELATED APPLICATIONS

This application is a continuation of U.S. patent application Ser. No. 14/613,350, filed Feb. 3, 2015, and claims the benefit under 35 U.S.C. § 119(e) of U.S. Provisional Patent Application No. 61/935,307 filed Feb. 3, 2014 and U.S. Provisional Patent Application No. 61/971,253 filed Mar. 27, 2014. These applications are incorporated herein by reference in their entireties.

TECHNICAL FIELD

The present invention relates generally to firearms. More specifically, the invention relates to firearms with bolt mechanisms, ambidextrous functionality, and/or isolated receivers.

BACKGROUND

Conventional bolt action firearms have bolt assemblies that hold cartridges in firing chambers and receivers and barrels for containing high pressures (e.g., 65,000 PSI) during firing. Bolt mechanisms often have lugs with flat bearing surfaces which engage corresponding flat load bearing surfaces of the receiver. The flat lug bearing surfaces are often perpendicular with respect to a longitudinal axis of the bolt assembly. Interaction between the sear and the firing pin often forces an aft end of the bolt upwards, thus misaligning it with respect to the receiver. Because the load bearing surfaces of the receiver and lugs are flat, misalignment of the bolt causes improper contact and/or separation between the load bearing surfaces. Although the lugs may ultimately bear against the receiver when the firearm is fired, the misalignment of the bolt may cause high stresses (e.g., stresses that cause damage to the bolt lugs and/or receiver) at contact points and excessive movement of the bolt that impairs accuracy of the firearm.

To reduce unintentional movement of the bolt, gunsmiths often lap lugs against the receiver to ensure that the lugs and receiver contact one another when the bolt is locked. The lapping process often includes applying an abrasive substance (e.g., an abrasive substance with the consistency of grease) to bearing surfaces and then cycling the bolt repeatedly. With every cycle the abrasive substance wears the bearing surfaces, thereby increasing the area across which they make contact with one another. Once the bearing surfaces of the lugs adequately contact the corresponding bearing surfaces of the receiver, the lapping process is complete. Unfortunately, the lapping process is laboriously and is not suitable for multi-caliber rifles because the bearing surfaces of the receiver are uniquely matched to the bearing surfaces of the lugs. The lapping process establishes the bolt and the receiver as a matched pair only after the lapping process has been completed. In order for additional bolts (e.g., different caliber bolts) to properly bear against the receiver, the lugs of each bolt must be iteratively lapped against the receiver to slightly alter the receiver with each iteration. This process must be repeated until the bearing surfaces of the receiver and each of the bolts converge upon a common solution. This iterative process is considerably more laborious than lapping a single bolt against a receiver and produces unique receiver bearing surfaces. As a result, bolt actions that require lapping do not support bolt interchangeability without considerable difficulty and are therefore not well suited for multi-caliber rifles.

Bolt action rifles are configured for either right-handed or left-handed operation. A bolt handle can be positioned on the right side of the firearm for right-handed operation or positioned on the left side of the firearm for left-handed operation. Unfortunately, complicated tools and additional components are needed to change a conventional firearm from a right- or left-handed configuration to a left- or right-handed configuration.

SUMMARY OF TECHNOLOGY

At least some aspects of the technology are directed to firearms that can accommodate different cartridges. A multi-caliber firearm can have a receiver and a bolt mechanism with a bolt that seats against one or more load bearing surfaces of the receiver. The bolt can have one or more lugs that slidably engage the load bearing surfaces of the receiver to maintain a high amount of contact when the bolt is in a locked state. The lugs can provide sufficiently large contact areas to provide a high level of contact to, for example, substantially eliminate stresses that would cause damage to the firing mechanism, minimize or limit movement of the bolt during firing to improve accuracy, and/or otherwise improve performance. Different bolts can be installed for multi-caliber functionality, and each of the bolts can seat against the load bearing surfaces of the receiver without lapping the lugs.

In some multi-caliber embodiments, a firearm comprises a receiver and a bolt assembly. The receiver has one or more non-planar receiver bearing surfaces (e.g., convex surfaces, concave surfaces, machined surfaces, etc.). The bolt assembly is positionable in the receiver and includes a bolt having one or more non-planar lug bearing surfaces. The lug bearing surfaces (e.g., convex surfaces, concave surfaces, machined surfaces, etc.) can slidably contact the one or more non-planar receiver bearing surfaces when the bolt moves between different positions, including an aligned position, a misaligned position, etc. In yet other embodiments, a multi-caliber firearm comprises a receiver and a bolt assembly positioned in the receiver. The bolt assembly can include an elongate bolt main body and a locking lug. The locking lug includes a lug bearing surface that physically contacts the receiver bearing surface to keep stresses at or below an acceptable stress level. For example, stresses can be kept sufficiently low to avoid damage to and/or permanent deformation of the receiver and/or bolt head. A wide range of sloped lugs can be used to contact sloped shoulders of the receiver.

The lug bearing surface, in some embodiments, can comprise a non-planar surface, such as a curved surface (e.g., concave or convex), a partially spherical surface (e.g., a surface with a substantially spherical shape), a partially toroidal surface (e.g., a surface with a substantially toroidal surface), or the like. The lug bearing surface can maintain contact with the receiver bearing surface when the bolt is moved away from an aligned position. In one embodiment, the lug bearing surfaces are partially toroidal surfaces and the receiver bearing surfaces are partially spherical surfaces. The bolt can be replaced with bolts having partially toroidal surfaces with similar or different curvatures.

In some embodiments, a bolt action for a firearm comprises a receiver having non-planar receiver bearing surfaces and a bolt assembly positionable in the receiver. The bolt assembly can include a bolt having non-planar lug bearing surfaces configured to maintain contact with corresponding non-planar receiver bearing surfaces regardless of alignment of the bolt mechanism with respect to the receiver when the bolt mechanism is in a ready to fire position. In certain embodiments, all of the non-planar lug bearing surfaces maintain simultaneous contact with the corresponding the non-planar receiver bearing surfaces when the bolt assembly is moved between an aligned position and any misaligned positioned. In certain embodiments, the non-planar receiver bearing surfaces and lug bearing surfaces are axisymmetric surfaces. The axis of revolution of one or both of the non-planar receiver bearing surface and the non-planar lug bearing surface is substantially parallel to a longitudinal axis of the bolt assembly. Regions of contact between each of the lug bearing surfaces and the corresponding non-planar receiver bearing surfaces can be maintained and can be insensitive to misalignment of the bolt mechanism. In certain embodiments, all of the lug bearing surfaces physically contact the corresponding non-planar receiver bearing surfaces irrespective of misalignment of the bolt mechanism when the bolt mechanism is in the ready to fire position. In some embodiments, the receiver bearing surfaces are coincident with a first single imaginary non-planer axisymmetric surface, and the lug bearing surfaces are coincident with a second single imaginary non-planar axisymmetric surface. The first and second single imaginary non-planer axisymmetric surfaces can be spherical shaped, conical shaped, parabolic, and/or toroidal shaped.

In some embodiments, a bolt action for a firearm comprises a receiver having non-planar means for engaging a bolt head. The bolt mechanism can include a bolt having non-planar means for engaging the receiver. The non-planar means for engaging the receiver is configured to maintain contact with corresponding non-planar means for engaging the bolt head regardless of alignment of the bolt mechanism with respect to the receiver when the bolt mechanism is in a ready to fire position. In some embodiments, the non-planar means for engaging a bolt head is coincident with a first single imaginary non-planer axisymmetric surface, and the non-planar means for engaging the receiver is coincident with a second single imaginary non-planar axisymmetric surface. The first and second single imaginary non-planer axisymmetric surfaces can be, for example, spherical shaped, conical shaped, parabolic, and/or toroidal shaped.

At least some aspects of the technology are directed to ambidextrous firearms that can be reconfigured for either right-handed or left-handed operation. An ambidextrous firearm can include a bolt assembly that is reconfigurable to position a bolt handle on either the right or left side of the firearm. In one embodiment, a firing pin assembly can be removed from the bolt assembly to allow repositioning of the bolt handle. The firing pin assembly can be reinstalled to lock the bolt assembly in the new configuration. As such, a single firearm can be reconfigured for right-handed or left-handed operation without using additional components, damaging components, and/or utilizing complicated tools.

In certain ambidextrous embodiments, the bolt assembly has a bolt body and a bolt handle. The bolt body can be a hollow member with first and second handle-receiving openings. The bolt handle includes a base and a knob. The base is positionable in the first handle-receiving opening to position the knob on a first side of the bolt assembly and is positionable in the second handle-receiving opening to position the knob on a second side of the bolt assembly. A firing pin assembly or other component can be used to lock the bolt handle in the desired position. In one embodiment, a plane (e.g., a midplane, a vertical imaginary plane extending through a longitudinal axis of the bolt assembly, etc.) defines the first and second sides of the bolt body.

A method for repositioning a bolt handle is provided herein. The method includes removing a firing pin, or firing pin assembly, from a bolt body and then separating the bolt handle from the bolt body. The bolt handle can be reinstalled at a different location along the bolt body and the firing pin assembly can be reinstalled to couple the bolt handle to the bolt body.

In some embodiments, a method for repositioning a bolt handle, which is coupled to a bolt body by a firing pin assembly of a firearm, includes removing the firing pin assembly from the bolt body. After removing the firing pin assembly from the bolt body, the bolt handle is moved from a side of the bolt body to another side of the bolt body. The firing pin assembly can be inserted into the bolt body to couple the bolt handle to the bolt body. For example, the bolt handle can be positioned on the right side of the firearm from the perspective of the user firing the firearm. The firing pin assembly can be removed from the bolt body to release the bolt handle. The released bolt handle can be installed on the bolt body such that the bolt handle is positioned on the left side of the firearm. The firearm can be manually reconfigured any number of times for left-handed or right-handed operation without replacing components (e.g., components of the bolt assembly or receiver assembly) and without using additional components or separate tools.

At least some aspects of the technology are directed to firearms with isolated components to enhance performance. Components of the firearms can be rotatably coupled to one another to minimize, limit, or substantially eliminate forces that would cause, for example, bending of components (e.g., bending of the receiver, barrel, etc.), damage to features, misalignment of components, or the like. In some embodiments, components are coupled together to allow relative movement between the components to accommodate forces without impairing accuracy. For example, the firearm can have a receiver coupled (e.g., pinned) to a chassis assembly to minimize, limit, or substantially prevent forces (e.g., torques) applied to the chassis assembly due to firing, thermal expansion/constriction, or applied loads (e.g., forces from bipods, slings, etc.) from being transmitted to the receiver. As such, the receiver can be isolated from externally applied loads imparted upon the chassis. The connections between the receiver and the chassis assembly can allow translation and/or rotation to avoid, for example, deformation of the barrel, chassis assembly, or other components. Such connections can include, without limitation, one or more pins, links, hinges, joints (e.g., ball and socket joints), combinations thereof, or the like.

At least some embodiments are directed to a firearm comprising a connection between a receiver and a chassis that will not transfer forces that would otherwise bend components of the firearm and adversely affect the relationship, for example, between the telescopic sight and the barrel. The forward end of the receiver can be pinned to the stock, chassis, or another component. A link can be pinned to an aft end of the receiver and can be pinned to the stock, chassis, or another component. The pins can be generally cylindrical, and each pin can have an axis of revolution that is generally perpendicular to a plane along a bore axis of the firearm. For example, each pin can have a longitudinal axis that is generally perpendicular to a vertical plane (e.g., a midplane) extending along the bore axis of the firearm. The link may be more robust than a pin through a slot cut into the receiver. Accurately controlled pin and hole diameters of the link are more easily achieved than accurately controlling, for example, a slot width. Moreover, line contact between pins and slots offer less stiffness and less wear resistance due to the high contact stress. A pin in a hole does not suffer from these problems.

In some embodiments, a firearm comprises a receiver, a chassis assembly, a pin, and a link assembly. The pin can rotatably couple the receiver to the chassis or stock assembly. The link assembly can include an upper pin coupled to the receiver, a lower pin coupled to the chassis assembly, and a link rotatably coupled to the upper pin and rotatably coupled to the lower pin. In one embodiment, the link can rotate relative to the upper and lower pins to allow movement between the receiver and chassis assembly. In some embodiments, the link assembly can be positioned closer to a firing mechanism than the pin. In some embodiment, the link can have ends with spherical bearings to limit moments that can be imparted upon the receiver in order to inhibit or prevent bending of the receiver.

In certain embodiments, a firearm can include a receiver, a chassis assembly, and means for accommodating axial displacement between, for example, the receiver and chassis assembly and/or means for preventing transferring moments from the chassis assembly to the receiver. The means can include one or more link assemblies that rotatably couple the receiver to the chassis assembly. Additionally or alternatively, the means for accommodating/preventing transferring can include one or more pins that rotatably couple the receiver to the chassis assembly. The pins can be received within holes, slots, or other features to provide the desired interaction. In another embodiment, the link can have spherical bearings so that it functions as a two force member to limit moments that can be imparted upon the receiver in order to inhibit or prevent bending of the receiver.

BRIEF DESCRIPTION OF THE DRAWINGS

Non-limiting and non-exhaustive embodiments are described with reference to the following drawings. The same reference numerals refer to like parts throughout the various views, unless otherwise specified.

DETAILED DESCRIPTION

The present technology is generally directed to, for example, bolt action firearms, firearms with ambidextrous functionality, bolt mechanisms, barrel-receiver connections, and/or receiver-bolt connections. Specific details of numerous embodiments of the technology are described below with reference to FIGS. 1-23. A person of ordinary skill in the art will understand that the technology can have other embodiments with additional elements and features, or the technology can have other embodiments without several of the features shown and described below with reference to FIGS. 1-23. The terms "aft", "proximal", "fore", and "distal" are used to describe the illustrated embodiments and are used consistently with the description of non-limiting exemplary applications. The terms aft/proximal and fore/distal are used in reference to the user's body when a user fires a firearm, unless the context clearly indicates otherwise.

Figure 1:
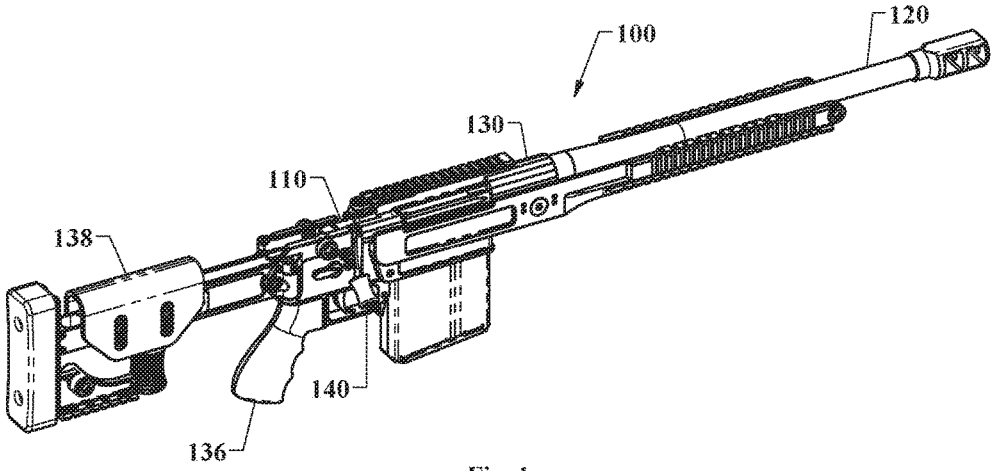
FIG. 1 is an isometric view of a firearm in accordance with one embodiment.
Figure 2:
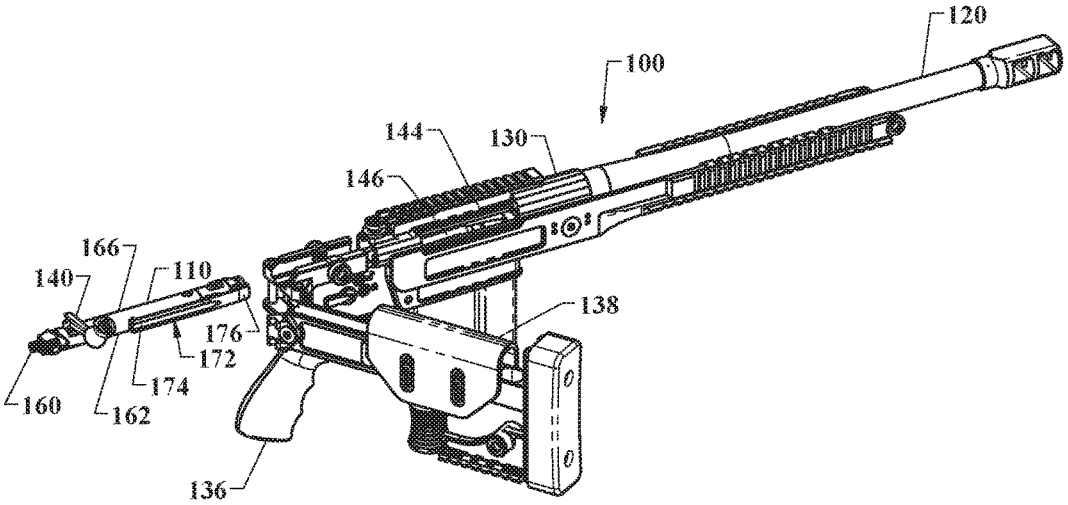
FIG. 2 is an isometric view of the firearm of FIG. 1 with a bolt assembly removed from a receiver in accordance with one embodiment.

FIGS. 1 and 2 are isometric views of a firearm 100 in accordance with one embodiment. The firearm 100 is an ambidextrous, multi-caliber rifle that can include a bolt assembly or mechanism 110 ("bolt mechanism 110"), a barrel 120, a receiver 130, a grip 136, and a stock assembly 138. The bolt mechanism 110 can be used to load a cartridge into a firing chamber (FIG. 2 shows a cartridge 146 in a chamber 144 ready to be loaded into a firing chamber) and can be configured for right-handed or left-handed operation. The bolt mechanism 110 can hold a shell (or a casing) of a cartridge during firing, and after firing the projectile, the bolt mechanism 110 can be moved from a ready to fire position (FIG. 1) toward an unlocked or open position to extract and eject the empty shell. The bolt mechanism 110 can be moved back to the locked position to reload the firearm 100.

FIG. 2 shows the bolt mechanism 110 after it has been removed from the receiver 130. After the stock assembly 138 is moved from a closed position (FIG. 1) to an open position (FIG. 2), the bolt mechanism 110, shown configured for right-handed operation, can be removed from the receiver 130, reconfigured for left-handed operation, and then reinstalled. Alternatively, components of the bolt mechanism 110 can be replaced for use with different cartridges.

The bolt mechanism 110 can include a handle assembly 140 and a bolt 162. The bolt 162 can include a tubular main body 166 for housing a firing pin assembly 160. An extractor assembly 172 can be an extractor positioned along the side of the bolt 162 and with a biasing portion 174 and a claw portion 176. The biasing portion 174 can urge claw portion 176 toward an engagement position for receiving a rim of a cartridge shell or case in a feature of the claw portion 176 (e.g., a slot in the claw portion 176). After the claw portion 176 receives the rim, the extractor assembly 172 can extract the shell when the bolt mechanism 110 moves proximally away from the firing chamber.

Figure 3:
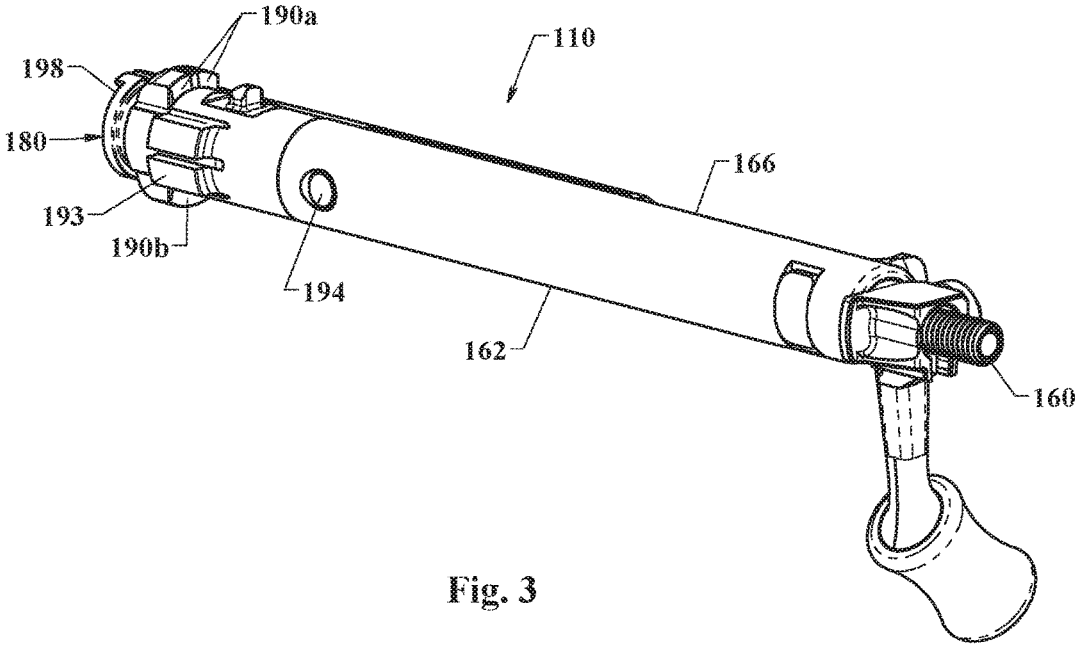
FIG. 3 is a rear, top, and left side isometric view of a bolt mechanism and a firing pin assembly in accordance with one embodiment.

FIG. 3 is a rear, top, and left side isometric view of the bolt mechanism 110 and firing pin assembly 160 in accordance with one embodiment. The bolt mechanism 110 can include a bolt head assembly 180 with a bolt head 198 and a bolt head pin 194 connecting the bolt head 198 to the bolt body 166. The bolt head 198 can include lugs 190*a*, 190*b* (collectively "lugs 190") for locking the bolt mechanism 110 to the receiver. The bolt 162 can be rotated to rotate the lug 190*a* and a guide 193 (one identified in FIG. 3) relative to the receiver 130. The bolt head pin 194 can be removed to replace the bolt head 198 with another bolt head.

Figure 4:
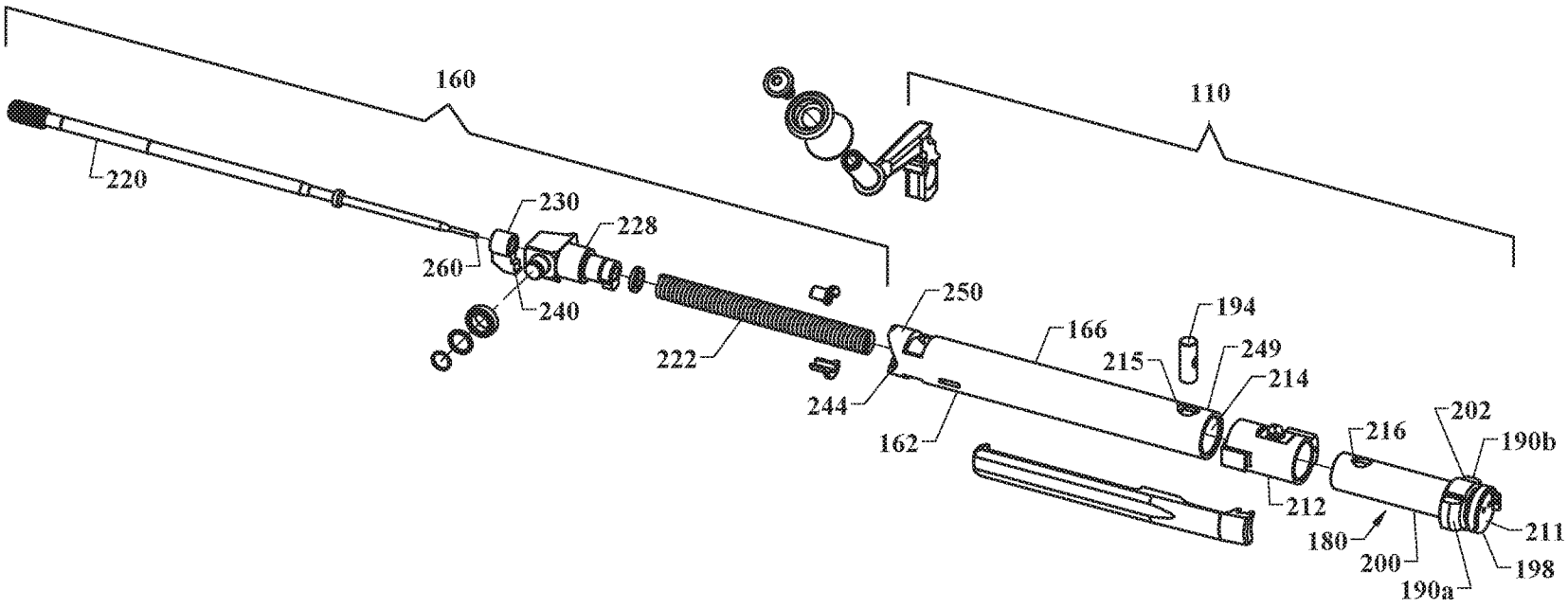
FIG. 4 is a front right side exploded view of the bolt mechanism and the firing pin assembly.

FIG. 4 is a front and right side exploded view of the bolt mechanism 110 and firing pin assembly 160. The bolt head 198 is configured to engage the shell of a cartridge and can include a pin portion or elongate main body 200 ("pin portion 200"), a head portion 202, and a cartridge interface 211. The pin portion 200 can be passed through a collar 212 and into a fore or distal end 249 of the bolt body 166. After the pin portion 200 is positioned in a passageway 214 in the bolt 162, the bolt head pin 194 can be positioned in openings 215 (one identified) in the main body 166 and a through-hole 216 of the pin portion 200. The components, configurations, and features of the bolt head 198 can be selected based on, for example, the desired removability and/or motion of the bolt head 198.

The firing pin assembly 160 can include a firing pin 220, a firing pin spring 222, a bolt shroud assembly 228, and a cocking element or striker 230. The bolt shroud assembly 228 may also be referred to as a "bolt sleeve" or "striker shroud." The striker 230 has a firing pin cam member 240, which can engage a multi-way camming feature 440 of the bolt 162. The firing pin assembly 160 can be inserted into the aft or proximal end 250 of the bolt 162 and advanced distally through the passageway 214 to position a tip 260 of the firing pin 220 within the bolt head assembly 180. Other types of firing pin assemblies can be used with the bolt mechanism 110.

Figure 5:
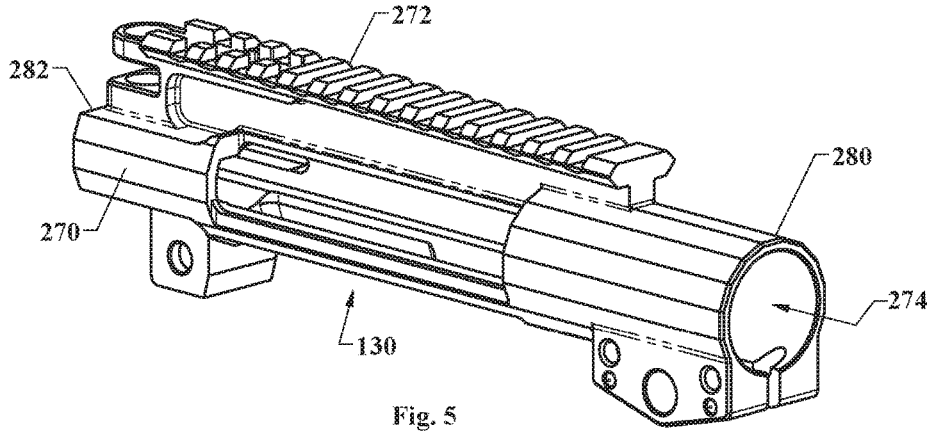
FIG. 5 is a front, top, and right side isometric view of a receiver in accordance with one embodiment.
Figure 6:
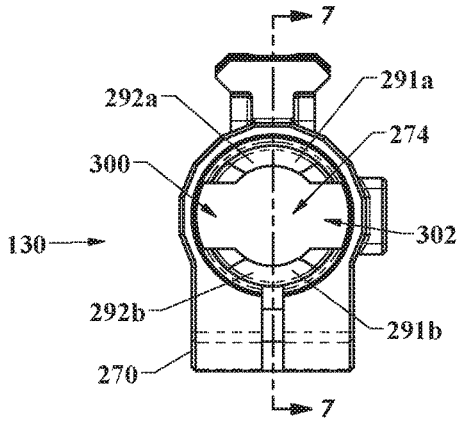
FIG. 6 is a front view of the receiver of FIG. 5.
Figure 7:
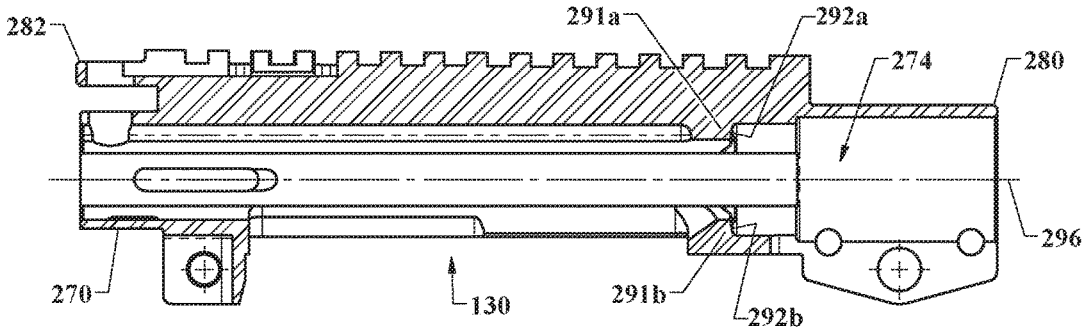
FIG. 7 is a cross-sectional view of the receiver taken along line 7-7 of FIG. 6.

FIG. 5 is a front, top, and right side isometric view of the receiver 130 in accordance with one embodiment. FIG. 6 is a front view of the receiver 130, and FIG. 7 is a cross-sectional view of the receiver 130 taken along line 7-7 of FIG. 6. Referring to FIG. 5, the receiver 130 can include a main body 270 and an attachment rail 272. The main body 270 can define a passageway 274 that extends from a fore or distal end 280 to an aft or proximal end 282. The fore end 280 can be internally threaded or otherwise configured to engage features of a barrel (e.g., barrel 120 of FIGS. 1 and 2).

Referring to FIGS. 6 and 7 together, the receiver 130 can include shoulders 291*a*, 291*b* that define non-planar receiver bearing surfaces 292*a*, 292*b*, respectively, positioned on opposite sides of a longitudinal axis 296 (FIG. 7) of the passageway 274. The receiver bearing surfaces 292*a*, 292*b* (collectively "receiver bearing surfaces 292") face generally toward the barrel (e.g., barrel 120 of FIGS. 1 and 2) and are positioned to contact lugs when the bolt mechanism is in the firing or locked position, as discussed in connection with FIGS. 8-14. When the bolt mechanism is at an unlocked or open position, the lugs can be aligned with and moved through the features 300, 302 (FIG. 6), which can be gaps, channels, or grooves, for example. The configuration and features of the receiver 130 can be selected based on the desired functionality. For example, the receiver 130 may have an integrally formed rail 272. In other embodiments, the rail 272 can be a separate component that is coupled to the main body 270 by, for example, one or more fasteners.

Figure 8:
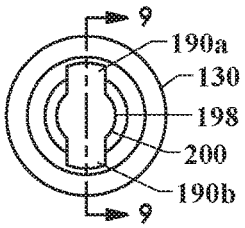
FIG. 8 is a schematic front view of a portion of the receiver and a bolt head assembly in accordance with one embodiment.
Figure 9:
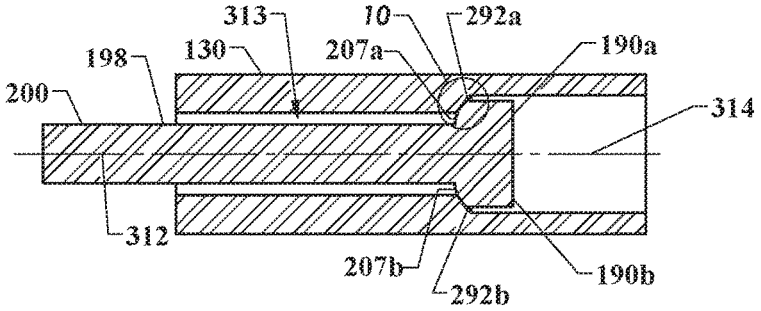
FIG. 9 is a schematic cross-sectional view of the assembly of FIG. 8 taken along line 9-9.

FIG. 8 is a schematic front view of a portion of the receiver 130 and the bolt head 198 when the bolt mechanism is in a locked state. FIG. 9 is a schematic cross-sectional view of the assembly of FIG. 8 taken along line 9-9. The lugs 190 are configured to avoid high stresses (e.g., stresses at point contacts between edges of the lugs 190 and the receiver bearing surfaces 292) so that stresses can be kept at or below an acceptable level. During firing, most of the force applied by the bolt head 198 to the receiver 130 is applied by areas of lug bearing surfaces that lay generally flat along the receiver bearing surfaces 292. This minimizes or reduces movement of the bolt head 198 during a firing event and thereby improves firearm accuracy.

Referring to FIG. 9, non-planar lug bearing surfaces 207*a*, 207*b* (collectively "lug bearing surfaces 207") of the respective lugs 190*a*, 190*b* and corresponding receiver bearing surfaces 292*a*, 292*b* of the receiver 130 can cooperate to maintain a desired relationship before, during, and/or after a firing event. For example, the lug bearing surfaces 207 can slidably contact the corresponding receiver bearing surfaces 292 when the bolt head 198 moves between different positions (e.g., from an aligned position toward a misaligned position, from a misaligned position to an aligned position, etc.). The pin portion 200 of the bolt head 198 is positioned in a bore 313 of the receiver 130 such that a longitudinal axis 312 of the bolt head 198 is generally parallel with the longitudinal axis 296 of the receiver 130. During a firing event, most or substantially all the force applied by the bolt head 198 to the receiver 130 is applied by the lug bearing surfaces 207.

Figure 10:
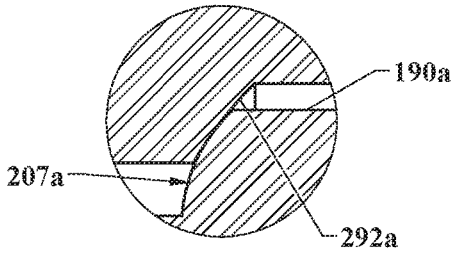
FIG. 10 is a detailed view of an interface between the lug and a receiver bearing surface.

FIG. 10 is a detailed view of the lug bearing surface 207*a* contacting the receiver bearing surface 292*a* to limit axial movement of the bolt head 198 in the proximal direction. The bearing surfaces 207*a*, 292*a* can generally contact one another along an arc that generally bisects the lug bearing surface 207*a*. The line contact becomes area contact during the firing event as the mating surfaces 207*a*, 292*a* elastically deform under load. In some embodiments, the receiver bearing surface 292*a* can have a curvature that is complementary to a curvature of the lug bearing surface 207*a* such that a sufficiently large the area of the lug bearing surface 207*a* facing or overlaying the receiver bearing surfaces 292*a* physically contacts the receiver bearing surfaces 292 to avoid damaging the receiver bearing surfaces 292 during the firing event.

Referring to FIGS. 9 and 10, the lug 190*a* can be partially toroidal, the lug bearing surface 270*a* can have a partially toroidal shape, and the receiver bearing surface 292*a* can have a partially spherical shape. These complementary shapes ensure that the bolt lugs 190 properly bear against the receiver 130 even when the bolt head 198 is misaligned with respect to the receiver 130. The toroidal lug bearing surfaces 207 can contact large areas of the receiver bearing surfaces 292. In other embodiments, the receiver bearing surfaces 292 can be substantially conical, substantially parabolic, substantially elliptical, or other curved shape suitable for contacting the non-planar lug bearing surfaces 207. For example, the receiver bearing surfaces 292 can be partially spherical surfaces, partially elliptical surfaces, or partially parabolic surfaces. In such embodiments, the lug bearing surfaces 207 can be partially spherical, partially toroidal, etc. In some embodiments, the receiver bearing surfaces 292 can be partially spherical and can engage parabolic or elliptical lug bearing surfaces 207. The configurations of the bearing surfaces 207, 292 can be selected to maintain contact irrespective of the angular position of the bolt head 198. In some embodiments, the receiver bearing surfaces 292 are coincident with a first single imaginary non-planer axisymmetric surface, and the lug bearing surfaces 207 are coincident with a second single imaginary non-planar axisymmetric surface. The first and second single imaginary non-planer axisymmetric surfaces can be spherical shaped, conical shaped, parabolic, and/or toroidal shaped. The lug bearing surfaces 207 can maintain simultaneous contact with the corresponding receiver bearing surfaces 292 irrespective of misalignment of the bolt head 198.

Figure 11:
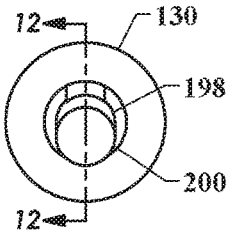
FIG. 11 is a schematic back view of the receiver portion and a bolt head assembly misaligned with the receiver in accordance with one embodiment.
Figure 12:
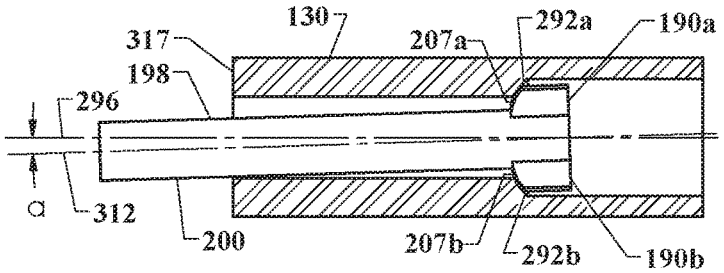
FIG. 12 is a schematic cross-sectional view of the assembly of FIG. 11 taken along line 12-12.
Figure 13:
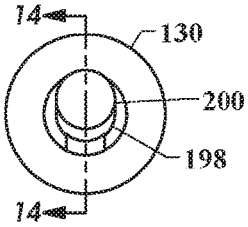
FIG. 13 is a schematic back view of the receiver portion and a bolt head assembly misaligned with the receiver in accordance with one embodiment.

FIG. 11 is a schematic back view of the bolt head 198 misaligned with the receiver 130. FIG. 12 is a schematic cross-sectional view of the assembly of FIG. 11 taken along line 12-12. Proper contact between the bolt lugs 190 and the receiver 130 exists when the bolt head 198 is misaligned. For example, line contact can be maintained along most of the circumferential length of the lugs 190. The illustrated elongate main body 200 is angularly misaligned with a sidewall 317 of the receiver 130. By controlling the contact between the lugs 190 and the receiver 130, the size of the lugs 190 can be optimized and reduced to increase the space available for other components of the firearm. Additionally, proper engagement between the lugs 190 and receiver 130 can reduce or limit bolt rotation about an axis (e.g., an axis perpendicular to a vertical plane extending along the longitudinal axis 312) during the firing event. This can significantly improve the overall performance/accuracy of the firearm.

Figure 14:
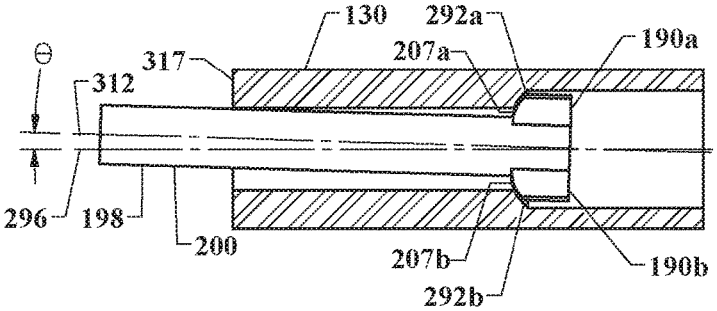
FIG. 14 is a schematic cross-sectional view of the assembly of FIG. 13 taken along line 14-14.

FIG. 12 shows the bolt head 198 in a maximum downwardly rotated position relative to the receiver 130. The longitudinal axis 312 of the bolt head 198 and the longitudinal axis 296 can define an angle $\alpha$. An upper portion of the lug 190*a* contacts the receiver bearing surface 292*a*, and a lower portion of the lug 190*b* contacts the receiver bearing surface 292*b*. Line contact (e.g., before or after a firing event) and/or large areas of contact (e.g., during a firing event when loads are applied) can be maintained independent of the angular position of the bolt head 198. The bolt head 198 of FIG. 14 is in a maximum upwardly rotated position relative to the receiver 130. The longitudinal axis 312 of the bolt head 198 and longitudinal axis 296 define an angle $\theta$. Referring now to FIGS. 12 and 14, one or both angles 8, a can be equal to or less than about 5 degrees, 3 degrees, 2 degrees, 1.5 degrees, 1 degree, or 0.5 degree without causing an appreciable decrease (e.g., 5%, 10%, or 15%) in the total contact (e.g., length of line contact, area of contact, etc.) between the bearing surfaces 207, 292. In one embodiment, one or both angles 8, a can be equal to or less than about 3 degrees, 2 degrees, or 1 degree. Other angles of misalignment are also possible. It is noted that components (e.g., bolt body) of the bolt mechanism are not shown in FIGS. 8-14 to avoid unnecessarily obscuring the illustrated features.

Figure 15:
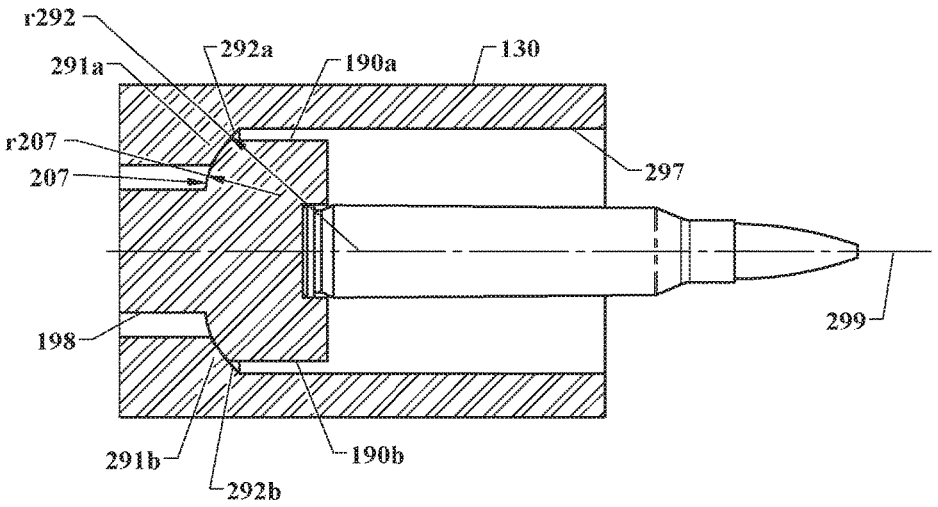
FIG. 15 is a cross-sectional view of a portion of a receiver and a bolt head in accordance with one embodiment.
Figure 16:
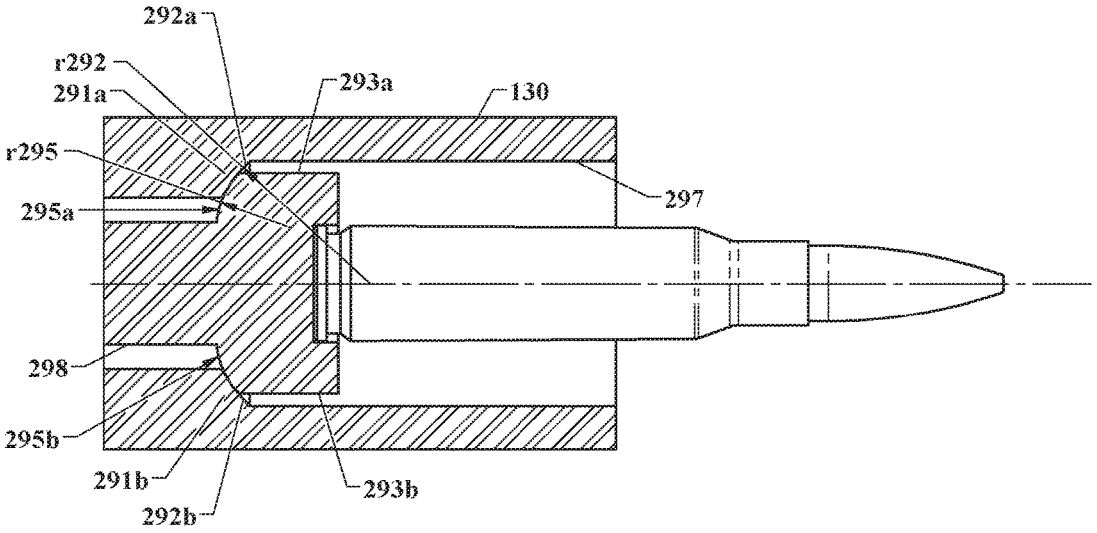
FIG. 16 is a cross-sectional view of a portion of the receiver of FIG. 15 and another bolt head.

FIG. 15 is a cross-sectional view of a portion of the receiver 130 and bolt head 198. FIG. 16 is a cross-sectional view the receiver 130 and a bolt head 298. The bolt head 198 of FIG. 15 can be for relatively small cartridges whereas the bolt head 298 of FIG. 16 can be for relatively large cartridges. Advantageously, the bolt heads 198, 298 of FIGS. 15 and 16 can be non-floating and non-lapped to avoid problems associated with floating bolt heads (e.g., bolt heads rotatable about two axes of rotation substantially perpendicular to a longitudinal axis of the bolts) and lapping lugs. Any number of bolt heads can be used with the receiver 130 without altering the receiver bearing surfaces 292*a*, 292*b*.

Each receiver bearing surface 292 can have a radius of curvature $r_{292}$, and each lug bearing surface 207 can have of a radius of curvature $r_{207}$. In some embodiments in which the lugs 190 are partially toroidal, the radius of curvature $r_{207}$ can be smaller than the radius of curvature $r_{292}$. Such partially toroidal lugs 190 have a shape corresponding to a circle rotated about an axis (e.g., an axis 299 in FIG. 15). The radius of curvature $r_{207}$ can be the radius of that circle and is commonly referred to as a "minor radius." The distance between the axis (e.g., axis 299) about which the circle is rotated and the center the circle is commonly referred to as a "major radius" of a torus. In some embodiments, the receiver bearing surfaces 292 can be partially spherical surfaces. A ratio of the radii of curvature $r_{207}$, $r_{292}$ can be between about 0.2 and about 1.5, between about 0.25 and about 1.75, or between about 0.75 and about 1.25. In other embodiments, each of bearing surfaces 207, 292 is partially spherical, and a ratio of the radius of curvature $r_{207}$ to the radius of curvature $r_{292}$ can be equal to or less than about 0.2, 0.3, 0.4, 0.5, 0.6, 0.8, 0.9, or 1, or between 0.7 and about 1, between about 0.8 and about 1, or between about 0.9 and about 1. In some embodiments, the ratio of the radius of curvature $r_{207}$ to the radius of curvature $r_{292}$ can be in a range of about 0.3 to about 0.4. In one embodiment, for example, the ratio can be about 3.5. Other curvatures can be selected based on the desired interaction between the bolt head 198 and the receiver 130. In some embodiments, radii of curvature $r_{207}$ in the distal direction (e.g., the radius of curvature taken along a plane that is generally parallel to a longitudinal axis of the receiver) is between about 0.5 inch to about 1 inch, between about 0.6 inch to about 0.9 inch, or between about 0.7 inch to about 0.9 inch. In certain embodiments, the radius of curvature $r_{207}$ is about 0.8 inch and a major radius of that toroidal lugs 190 can be between about 0.2 inch and about 0.3 inch or between about 0.22 inch and about 0.27 inch. In one embodiment, the major radius is about 0.255 inch. The radius of curvature $r_{292}$ can be between about 2 inches and 2.5 inches, between 2.1 inches and about 2.4 inches, or between about 2.2 inches and about 2.3 inches. In certain embodiments, the radius of curvature $r_{292}$ is about 2.2 inches, about 2.27 inches, or about 2.3 inches. Other radii of curvature and configurations can be selected based on the desired functionality a firearm, and the radius of curvature $r_{207}$ of the lug can be slightly less than the radius of curvature $r_{292}$ of the receiver 130 to avoid contact along edges.

FIG. 16 shows the bolt head 298 for a relatively large cartridge. Lugs 293*a*, 293*b* (collectively "lugs 293") of bolt head 298 are closer to the sidewall 295 than the lugs 190*a*, 190*b* of FIG. 15. In some embodiments, the lugs 293 have lug bearing surfaces 295*a*, 295*b* defining radii of curvature $r_{295}$. The $r_{295}$ can be smaller than, greater than, or substantially equal to the radius of curvature $r_{207}$ of FIG. 15. In some embodiments in which the lugs 293*a* are partially toroidal, the radius of curvature $r_{295}$ can be substantially equal to the radius of curvature $r_{207}$ of the lugs 190 of FIG. 15 so that the characteristics of the receiver bearing surfaces 292*a*, 292*b* can be maintained with repeated bolt cycling.

Figure 17:
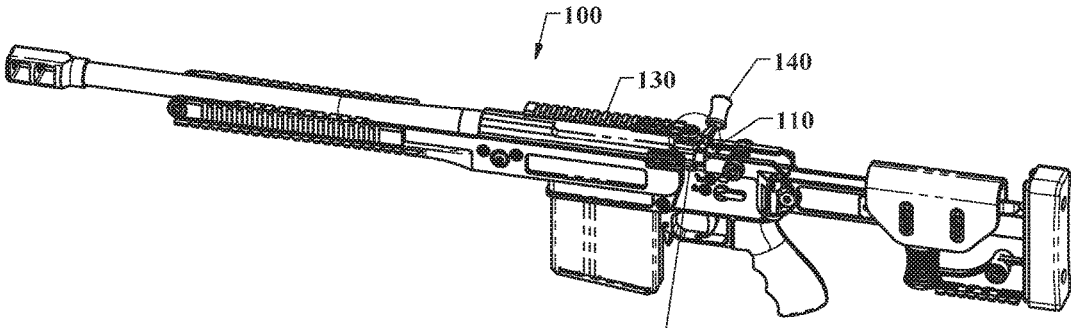
FIG. 17 is an isometric view of a firearm in accordance with one embodiment.
Figure 18:
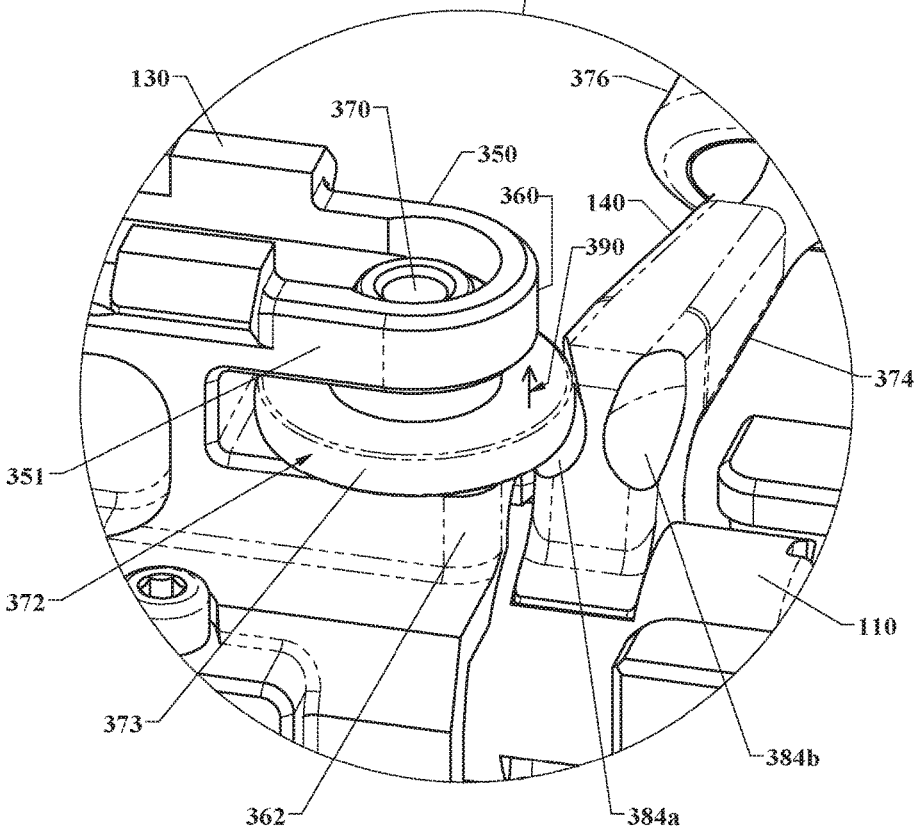
FIG. 18 is a detailed view of a camming mechanism of the firearm of FIG. 17.

FIG. 17 is an isometric view of the firearm 100, and FIG. 18 is a detailed view of a portion of the firearm 100. FIGS. 17 and 18 show the handle assembly 140 positioned for right-handed operation. The bolt mechanism 110 can be installed so that the handle assembly 140 is on either the right or left side of the firearm 100. For example, the bolt mechanism 110 can be reconfigured to switch the handle assembly 140 between right- or left-handed operation any number of times without replacing any of the components of the bolt mechanism 110, without utilizing complicated tools, etc.

Referring to FIG. 18, the receiver 130 can include a camming mechanism 350 for engaging the handle assembly 140 in an open position (shown in FIGS. 17 and 18). The camming mechanism 350 can include a cam roller holder 351 and a cam roller assembly 372. The cam roller holder 351 can include an upper member 360 and a lower member 362 spaced apart to receive the cam roller assembly 372. The cam roller assembly 372 can include a pin 370 and a cam roller 373. The pin 370 can be positioned in openings formed by the upper and lower members 360, 362. Other types of camming mechanisms can also be used, if needed or desired.

The handle assembly 140 can include a bolt handle 374 and a bolt knob 376. The bolt handle 374 can be an arm with extraction cam surfaces 384*a*, 384*b*. The cam roller 373 can function as a bolt stop and can be moved vertically (indicated by arrow 390) to allow for the removal of the bolt mechanism 110 from the receiver 130. When the bolt mechanism 110 is installed for right-handed operation, the cam roller 373 can physically contact the extraction cam surface 384*a*. When the bolt mechanism 110 is installed for left-handed operation, the cam roller 373 can physically contact the extraction cam surface 384*b*.

Figure 19:
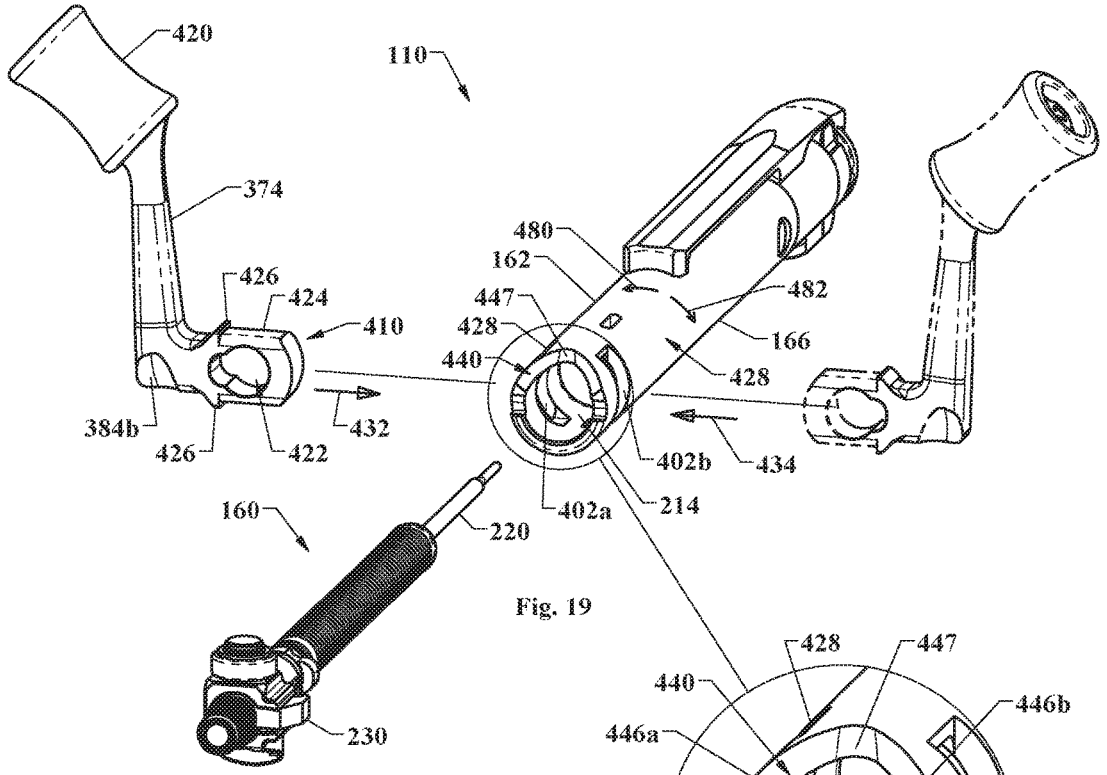
FIG. 19 is an exploded isometric view of a bolt mechanism and a firing pin assembly in accordance with one embodiment.

FIG. 19 is an exploded isometric view of the bolt mechanism 110 and the firing pin assembly 160. Handle-receiving openings 402*a*, 402*b* are located on opposite sides of the bolt body 166. The bolt handle 374 can include a connector portion 410 with an opening 422, a body or base 424 ("base 424"), and shoulders 426. The opening 422 is dimensioned to receive the firing pin assembly 160 when the base 424 is positioned in the bolt body 166 and the shoulders 426 can contact an outer surface 428 of the bolt body 166. The bolt handle 374 can be moved (indicated by arrow 432) to insert the base 424 into the handle-receiving opening 402*a* for right-handed operation. The handle assembly illustrated in phantom line can be moved (indicated by arrow 434) to insert the base 424 into the handle-receiving opening 402*b* for left-handed operation. When the base 424 is positioned within the passageway 214, the firing pin assembly 160 can be moved along the passageway 214 and through the opening 422 to lock the bolt handle 374 to the bolt body 166. The striker sleeve 228 or other component of the firing pin assembly 160 can be positioned through and retain the bolt handle 374.

Figure 20:
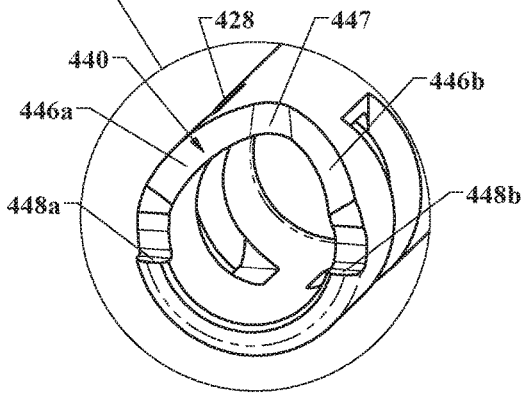
FIG. 20 is a detailed view of an end of a bolt body in accordance with one embodiment.

The bolt body 166 has a two-way camming feature 440 positioned to allow the operation of the firing pin assembly 160 when the bolt handle 374 is positioned in either the handle-receiving opening 402*a* or the handle-receiving opening 402*b*. Referring to FIG. 20, the two-way camming feature 440 can include camming surfaces 446*a*, 446*b* extending from a central region 447 to stops 448*a*, 448*b*, respectively. The stop 448*a* can be a notch positioned to stop rotation of the bolt body 166 in the one direction, and the stop 448*b* can be a notch positioned to stop rotation of the bolt body 166 in the opposite direction. In some embodiments, the two-way camming feature 440 is substantially V-shape or substantially U-shape as viewed from above and can be symmetrical relative to a midplane of the bolt body 166. The configuration and features of the two-way camming feature 440 can be selected based on desired operation of the firing pin assembly 160.

Figure 21:
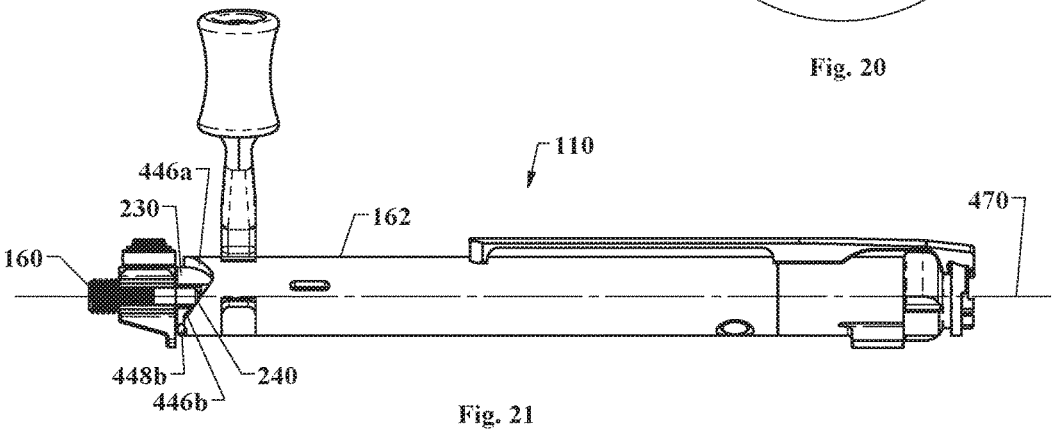
FIG. 21 is a bottom view of a bolt mechanism and firing pin assembly in accordance with one embodiment.

FIG. 21 is a bottom view of the assembled bolt mechanism 110 and firing pin assembly 160. The firing pin cam member 240 of the striker 230 can slidably engage the camming surfaces 446*a*, 446*b* to allow rotation of the bolt 162 about its longitudinal axis 470. The stop 448*b* (FIG. 20) can contact the firing pin cam member 240 to arrest rotation of the bolt body 166 when the bolt body 166 is rotated in the counterclockwise direction (indicated by arrow 480 in FIG. 17) during right-handed operation. The stop 448*a* (FIG. 20) can contact the firing pin cam member 240 to arrest rotation of the bolt body 166 in the clockwise direction (indicated by arrow 482 in FIG. 17) during left-handed operation.

Figure 22:
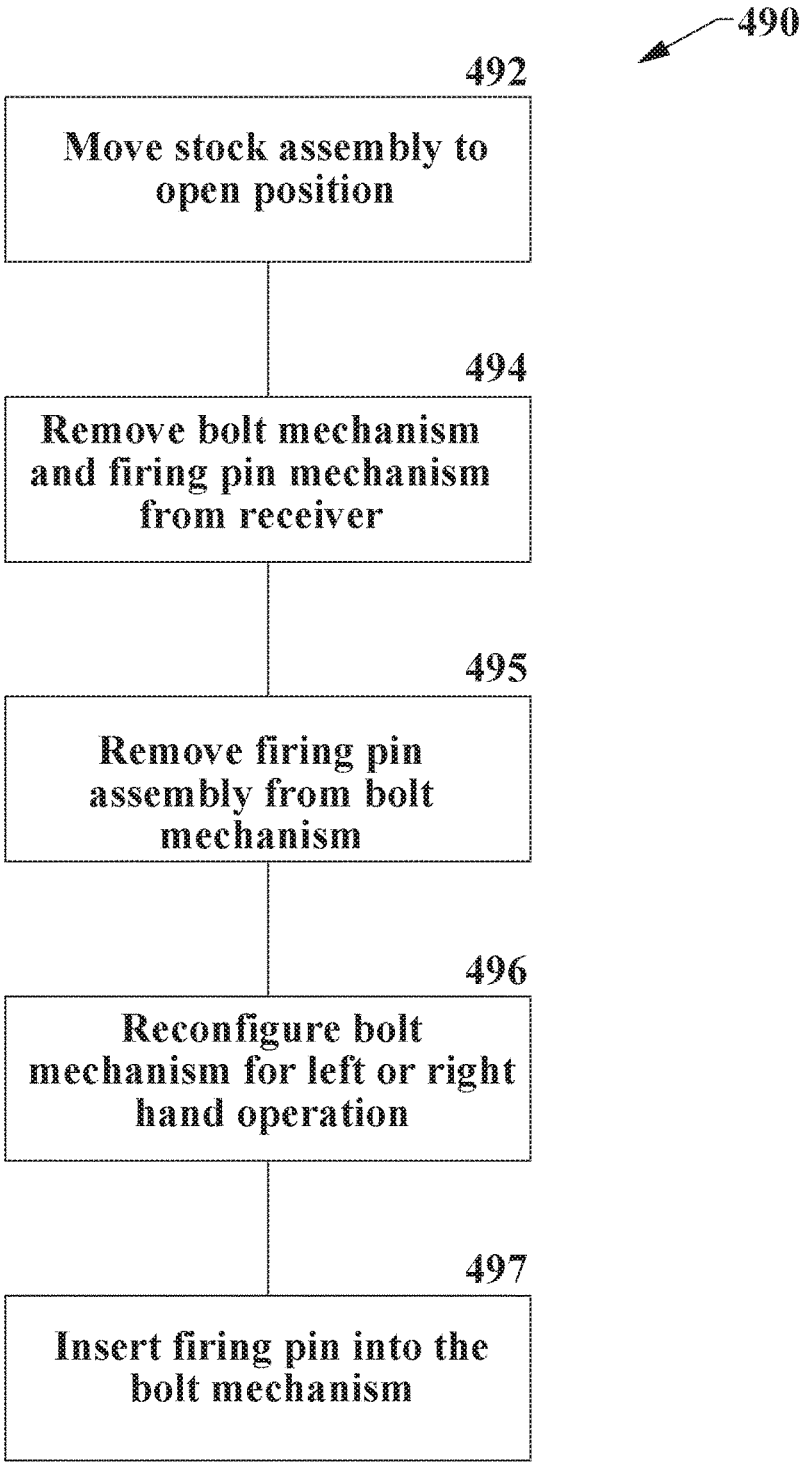
FIG. 22 is a flowchart illustrating the method of reconfiguring the bolt mechanism in accordance with some embodiments.

FIG. 22 is a flowchart illustrating a method 490 of reconfiguring bolt mechanisms in accordance with some embodiments. Generally, a bolt mechanism can be disassembled by lifting an extraction cam roller at the rear of the receiver and removing the bolt assembly from the receiver. Once the bolt assembly is out of the receiver, the firing pin assembly can be removed from the rear of the bolt body. The bolt handle assembly can then be removed from the bolt assembly because the firing pin assembly, which secures the bolt handle in the bolt body, is no longer retaining it. The bolt handle may then be inserted in the opposite side of the bolt body and secured by inserting the firing pin assembly back into the bolt body. The method 490 is discussed in detail below.

At block 492, the stock assembly 138 (FIGS. 1 and 2) is move from a closed position (FIG. 1) to an open position (FIG. 2). A release mechanism, latches, or other features can be used to unlock and lock the stock assembly 138.

At block 494, the bolt mechanism 110 and firing pin assembly 160 can be removed from the receiver 130 by rotating the handle assembly 140 of FIG. 1 upwardly until the extraction cam surface 384*a* (FIG. 18) contacts or is proximate to the cam roller 373. In some embodiments, the camming mechanism 350 can be moved from a locked position to an unlocked position to allow removal of the bolt mechanism 110 from the receiver 130. For example, the cam roller 373 can be moved upwardly (indicated by arrow 390 in FIG. 18) to unlock the camming mechanism 350. The bolt mechanism 110 and firing pin assembly 160 are then pulled out of the receiver 130.

At block 495, the firing pin assembly 160 can be removed from the bolt mechanism 110. For example, the firing pin 220 can be pulled proximally through the bolt mechanism 110 to release the handle assembly 140. At block 496, the bolt mechanism 110 can be reconfigured for right-handed or left-handed operation as discussed in connection with FIGS. 19 and 20. At block 497, the firing pin assembly 160 can be reinstalled in the bolt mechanism 110 by inserting the firing pin 220 through the opening 422 of the bolt handle 374 and the bolt head 198. The striker sleeve 228 or other component of the firing pin assembly 160 can retain the bolt handle 374.

Figure 23:
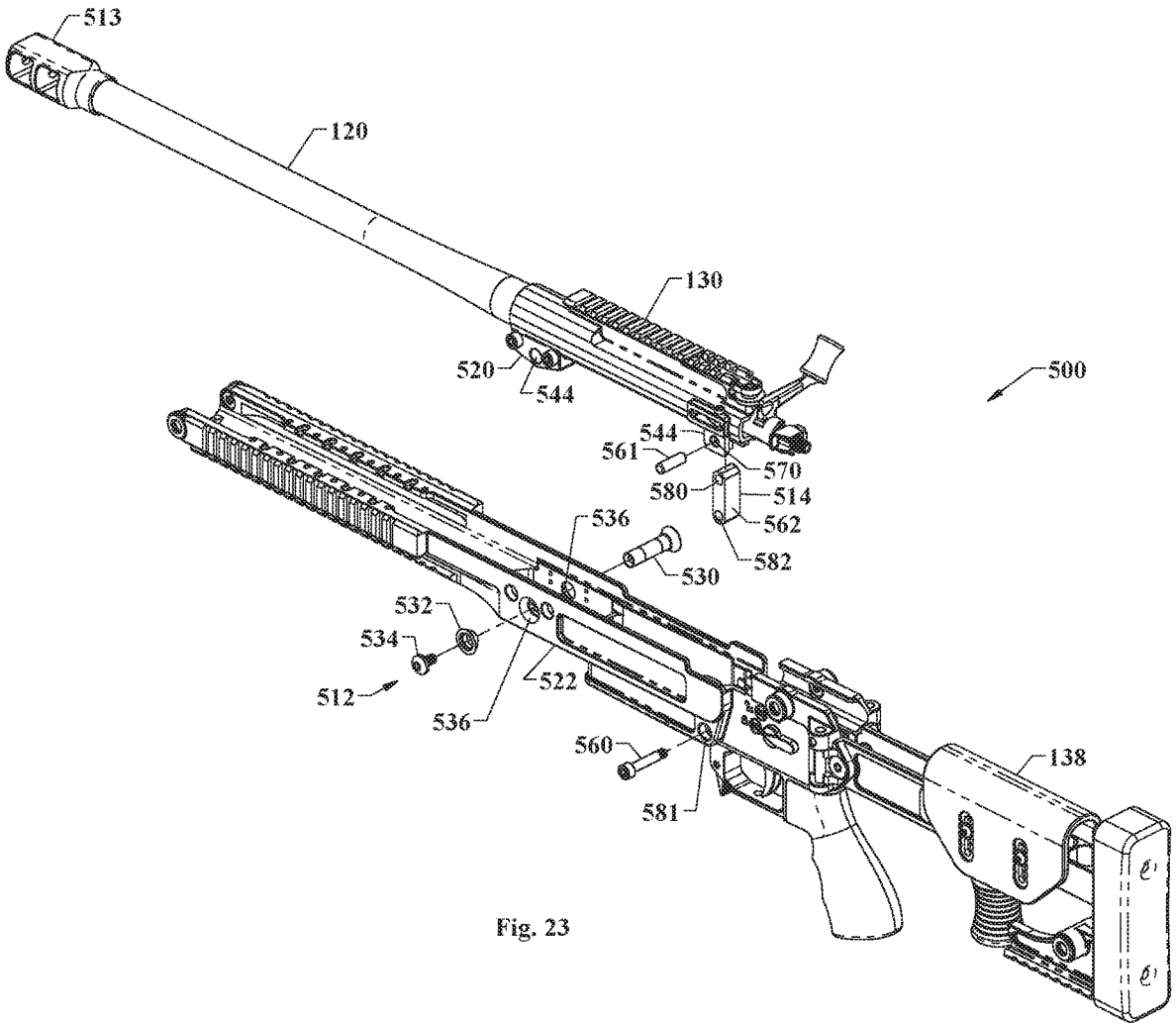
FIG. 23 is an exploded view of an isolated barrel-receiver assembly.

FIG. 23 is an exploded view of an isolated barrel-receiver assembly 500.

The receiver 130 can preserve the relationship between a sight (e.g., a telescopic sight mounted to the rail 272) and the barrel 120, both of which can be part of or affixed to the receiver 130. The barrel-receiver assembly 500 can be configured such that the receiver 130 does not undergo any deformation that can adversely affect this relationship prior to a firing event. As such, the scope-barrel relationship can be maintained from shot to shot. In some embodiments, the barrel-receiver assembly 500 can substantially prevent, reduce, or limit deformation of the firearm 100 to provide better accuracy than conventional firearms. The receiver 130 can avoid deformation when external forces are applied to the stock assembly 138. Such forces can stem from the use of a bipod or a sling in order to steady the firearm for an accurately placed shot. Changes in temperature can also impart forces due to differential growth rates between connected parts made from dissimilar materials, such as a steel of the receiver 130 and aluminum of the stock assembly 138. The barrel-receiver assembly 500 can be configured to avoid transferring forces from the stock assembly 138 to the receiver 130 that would otherwise bend the receiver 130 and, as a result, adversely affect the relationship between the receiver 130 and one or both of the telescopic sight and the barrel 120.

The barrel-receiver assembly 500 can include a pin assembly 512 and a link assembly 514. The pin assembly 512 is positioned between an end 513 of the barrel 120 through which a projectile exits the firearm 100 and the link assembly 514. The link assembly 514 is configured to accommodate axial displacement (e.g., displacement in a direction parallel to a bore axis of the firearm 100) between the receiver 130 and a chassis assembly 522. The pin assembly 512 can rotatably couple a bracket 520 of the receiver 130 to the chassis assembly 522 and can include a pin 530, a washer 532, and a bolt 534. The pin 530 is dimensioned to pass through openings 536 of the chassis assembly 522. The link assembly 514 can include an upper pin 561 coupleable to a bracket 544 of the receiver 130, a lower pin 560 couplable to the chassis assembly 522, and a link 562. The upper pin 561 can be positioned in an opening 570 of the bracket 544 of the receiver 130 and an opening 580 of the link 562. The lower pin 560 can be positioned in openings 581 of the chassis assembly 522 and an opening 582 of the link 562. Each of the installed pins 530, 560, 561 be generally cylindrical and can have a longitudinal axis or revolution axis that is generally perpendicular to the midplane of the firearm 100. For example, each pin 530, 560, 561 can have a longitudinal axis that is generally perpendicular to an vertical plane extending along the bore axis of the firearm 100.

Other connections can be used. In some embodiments, the link 562 can have spherical bearings at both ends effectively making in a two force member to limit that moments that can be imparted upon the receiver 130 in order to minimize, limit, or substantially prevent bending of the receiver 130. The connections disclosed herein can also be used to isolate other components. For example, connections can be used to provided isolated receiver-bolt connections.

The embodiments, features, extractors, bolt mechanisms, methods and techniques described herein may, in some embodiments, be similar to and/or include any one or more of the embodiments, features, firing components, systems, devices, materials, methods and techniques described in U.S. Pat. No. 7,743,543; U.S. Pat. No. 8,572,885; application Ser. No. 13/771,021, U.S. Provisional Patent Application No. 61/600,477; and U.S. Provisional Patent Application No. 61/602,520. U.S. Pat. No. 7,743,543, U.S. patent application Ser. No. 13/771,021, U.S. Provisional Patent Application No. 61/600,477; and U.S. Provisional Patent Application No. 61/602,520 are incorporated herein by reference in their entireties. In addition, the embodiments, features, systems, devices, materials, methods and techniques described herein may, in certain embodiments, be applied to or used in connection with any one or more of the embodiments, firearms, features, systems, devices, materials, methods and techniques disclosed in the above-mentioned U.S. Pat. No. 7,743,543; U.S. Provisional Patent Application No. 61/600,477; and U.S. Provisional Patent Application No. 61/602,520. The bolt mechanisms and other features disclosed herein can be incorporated in into a wide range of different firearms (e.g., rifle, pistol, or other portable guns) to receive cartridges and removing empty cartridge shells.

From the foregoing, it will be appreciated that specific embodiments of the invention have been described herein for purposes of illustration, but well-known structures and functions have not been shown or described in detail to avoid unnecessarily obscuring the description of at least some embodiments of the invention. Where the context permits, singular or plural terms may also include the plural or singular term, respectively. Unless the word "or" is associated with an express clause indicating that the word should be limited to mean only a single item exclusive from the other items in reference to a list of two or more items, then the use of "or" in such a list shall be interpreted as including (a) any single item in the list, (b) all of the items in the list, or (c) any combination of the items in the list. The singular forms "a," "an," and "the" include plural referents unless the context clearly indicates otherwise. Thus, for example, reference to "a spring" refers to one or more springs, such as two or more springs, three or more springs, or four or more springs.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A firearm, comprising:
- a receiver;
- a chassis assembly;
- a pin rotatably coupling the receiver to the chassis assembly; and
- a link assembly rotatably coupling the receiver to the chassis assembly while the firearm is configured to fire a projectile, the link assembly including
  - an upper pin coupled to the receiver,
  - a lower pin coupled to the chassis assembly, and
  - a link rotatably coupled to the receiver by the upper pin and rotatably coupled to the chassis assembly by the lower pin, wherein the link is housed within the chassis assembly.

2. The firearm of claim 1, wherein the link assembly is configured to accommodate at least one of rotation or translation between the receiver and the Chassis assembly.

3. The firearm of claim 2, wherein the link assembly accommodates translation of a portion of the receiver relative to the chassis assembly when the portion of the receiver translates in a direction substantially parallel to a bore axis of the firearm.

4. The firearm of claim 1, wherein the pin is positioned between an end of the barrel through which a projectile exits the firearm and the link assembly.

5. The firearm of claim 1, wherein the receiver includes a first opening and a second opening, wherein the pin is located in the first opening, and wherein the upper pin is located in the second opening.

6. A firearm comprising:

a receiver;

a chassis assembly;

a pin rotatably coupling the receiver to the chassis assembly; and a link assembly including an upper pin coupled to the receiver, a lower pin coupled to the chassis assembly, and a link rotatably coupled to the receiver by the upper pin and rotatably coupled to the chassis assembly by the lower pin such that the link assembly allows movement between the receiver and the chassis assembly when the firearm is configured to fire a projectile, wherein a body of the link extends between the upper pin and the lower pin and is positioned inside of the chassis assembly.

* * * * *